US007976353B2

(12) United States Patent
Myer et al.

(10) Patent No.: US 7,976,353 B2
(45) Date of Patent: Jul. 12, 2011

(54) TWO-PIECE ELECTRICAL TERMINAL

(75) Inventors: John Mark Myer, Millersville, PA (US); Hurley Chester Moll, Hershey, PA (US); Leo J. Graham, Hershey, PA (US); Forrest I. Kinsey, Jr., Harrisburg, PA (US)

(73) Assignee: Tyco Electronics Corporation, Middleton, PA (US)

( * ) Notice: Subject to any disclaimer, the term of this patent is extended or adjusted under 35 U.S.C. 154(b) by 216 days.

(21) Appl. No.: 11/668,944

(22) Filed: Jan. 30, 2007

(65) Prior Publication Data

US 2008/0081520 A1 Apr. 3, 2008

Related U.S. Application Data

(63) Continuation-in-part of application No. 11/540,219, filed on Sep. 29, 2006, now Pat. No. 7,422,494.

(51) Int. Cl.
*H01R 9/24* (2006.01)

(52) U.S. Cl. ..... 439/891

(58) Field of Classification Search ..... 439/891, 439/866, 843, 884, 862, 825, 871, 850
See application file for complete search history.

(56) References Cited

U.S. PATENT DOCUMENTS

| | | | | |
|---|---|---|---|---|
| 4,880,401 | A | | 11/1989 | Shima et al. |
| 5,240,439 | A | | 8/1993 | Egenolf |
| 5,246,390 | A | | 9/1993 | Egenolf |
| 5,266,056 | A | | 11/1993 | Baderschneider et al. |
| 5,271,741 | A | | 12/1993 | Saito et al. |
| 5,308,267 | A | | 5/1994 | Hotea |
| 5,338,229 | A | | 8/1994 | Egenolf |
| 5,399,110 | A | * | 3/1995 | Morello et al. ..... 439/879 |
| 5,468,163 | A | | 11/1995 | Egenolf |
| 5,649,842 | A | | 7/1997 | Ohsumi |
| 5,716,244 | A | | 2/1998 | Egenolf et al. |
| 5,716,246 | A | * | 2/1998 | Kerckhof et al. ..... 439/884 |
| 5,879,205 | A | | 3/1999 | Egenolf et al. |
| 5,888,107 | A | * | 3/1999 | Seymour et al. ..... 439/891 |
| 6,004,172 | A | * | 12/1999 | Kerek ..... 439/891 |
| 6,132,264 | A | | 10/2000 | Egenolf |
| 6,290,556 | B1 | * | 9/2001 | Howland et al. ..... 439/879 |
| 6,672,910 | B2 | | 1/2004 | Hotea |
| 6,890,222 | B2 | | 5/2005 | Serbin et al. |
| 2005/0118884 | A1 | | 6/2005 | Lutsch et al. |

FOREIGN PATENT DOCUMENTS

| | | |
|---|---|---|
| FR | 2 759 500 | 8/1998 |

OTHER PUBLICATIONS

International Search Report PCT/US2007/019703; mailed Mar. 4, 2008.

* cited by examiner

*Primary Examiner* — Alexander Gilman

(57) ABSTRACT

A two piece electrical terminal is shown where one part is comprised of a contact member having a contact section in the form of a pin and retention section. A conductor connecting member is comprised of a conductor connecting section and a retaining member. The contact member has a lug extending along one side thereof and the retaining member has a complementary opening which retains the contact member and conductor connecting member together.

10 Claims, 18 Drawing Sheets

TWO-PIECE ELECTRICAL TERMINAL

This application is a Continuation-in-Part, and claims the benefit of, U.S. patent application Ser. No. 11/540,219 filed Sep. 29, 2006, the complete disclosure of which is hereby expressly incorporated by reference.

BACKGROUND OF THE INVENTION

The subject invention relates to a pin terminal for electrical connection with a corresponding socket terminal.

It is common in electrical connector technology to provide a plurality of wires for example in a harness configuration, attached to a connector housing, and another plurality of wires attached to another harness in yet another complementary connector. One of the connectors would have pin terminals while the other of the connectors would include a receptacle or socket terminal. Multiple considerations need to be considered in designing and manufacturing such terminals, particularly when the application to which the connectors will be subjected to, is considered.

For example, in the automotive field, when electrical connectors are required in a plurality of harness connections, the pins and receptacles are subjected to multiple adverse conditions. First, vibration from the engine or road conditions sometimes provides degradation to the pin and socket connection. Due to the inclement weather conditions in which the automobile needs to operate, most automotive connectors are also sealed, which prevents either water or salt water from encroaching into the connector housing and degrading the electrical connection between the pins and receptacles. Thus for the sealing purposes, it is required to have a pin terminal which is easily insertable through a seal member or a planar seal which seals the back of the electrical connector.

It is known to provide a two piece electrical terminal where a portion is the pin portion and a second portion is the wire crimp which is connected to the pin portion. Typically these two pieces are soldered or laser welded together which can form sharp surfaces which can cut or sever the seals upon insertion there through. It is also necessary to provide a continued connection between the pin portion and the wire connecting portion for making the electrical connection.

SUMMARY OF THE INVENTION

These and other improvements have been achieved by way of providing an electrical terminal, comprising a contact member comprised of a contact section and a retention section. The retention section having at least one locking surface. A conductor connecting member is comprised of a conductor connecting section and a retaining member, where the retaining member engages the at least one locking surface to retain the contact member and conductor connecting member together, in an electrically connected manner.

The retaining member may comprise a locking member which retains the at least one locking surface to retain the contact member and conductor connecting member together. The locking member and the locking surface may be locked by an interference fit. The retaining member may be comprised of plural walls which at least partially overlap said retention section. The retaining member may be in the form of a box-shaped portion overlapping said retention section. The locking member may be formed in one of the plural walls of the retaining member.

The one locking surface may defined by an undulation, and said locking member may be defined by an opening which interferingly fits with said undulation. The undulation may be in the form of a tab extending from a side edge thereof. The one locking surface may be defined by an undulation, and the locking member is defined by a rearwardly directed arm, which interferingly fits with said undulation. The rearwardly directed arm may extend at least partially over the undulation, and the retention section is deformed for interfering engagement with the rearwardly directed arm.

The retention section may make electrical contact with the retaining member. The retention section may comprise a blade portion and the retaining portion comprises at least one upwardly directed contact tab which contact the blade portion.

In another embodiment, an electrical terminal, comprises a contact member comprised of a contact section; a conductor connecting member is comprised of a conductor connecting section; a retention section is attached to one of the contact member or the conductor connecting member; and a retaining member is attached to the other of the contact member or the conductor connecting member, the retaining member being in the form of a box-shaped member which engages the retention section, and the retaining member and the retention section are electrically connected.

The retention section may comprise at least one locking surface to retain the contact member and conductor connecting member together. The one locking surface may be defined by an undulation, which may be in the form of a tab. One of the plural walls of the box-shaped portion may have an engagement portion for engagement with the tab, where the engagement is interference fit engagement. The tab is interference fit within an opening in a sidewall of one of said plural walls. The one wall of the box shaped member may have a rearwardly directed arm which interferingly engages with the tab.

In yet another embodiment, an electrical terminal, comprises a contact member comprised of a contact section and a retention section; and a conductor connecting member comprised of a conductor connecting section and a retaining member, the retaining member interferingly engaging the retention section to retain the contact member and conductor connecting member together.

The retention section may comprise at least one locking surface; and the retaining member interferingly engaging the at least one locking surface to retain the contact member and conductor connecting member together. The retaining member may comprise a locking member which retains the at least one locking surface to retain the contact member and conductor connecting member together. The retaining member may further comprise a forwardly facing opening having a notch, where the contact member has a portion extending into the opening. The contact member portion extending into the opening is deformed to lock the contact member and retaining member together.

Finally, a method of forming an electrical terminal, comprises the steps of forming a contact member comprised of a contact section and a retention section; forming at least one locking surface on said retention section; forming a conductor connecting member comprised of a conductor connecting section and a retaining member; and causing movement between at least a portion of either the retention section or the retaining member relative to the other and into engagement therebetween, in order to retain the contact member and conductor connecting member together.

The retention section is also brought into electrical contact with the retaining member. The step of causing movement between at least a portion of either the retention section or the retaining member relative to the other comprises deformation of either the retention section or the retaining member.

DETAILED DESCRIPTION OF THE EMBODIMENTS

Figure 1:
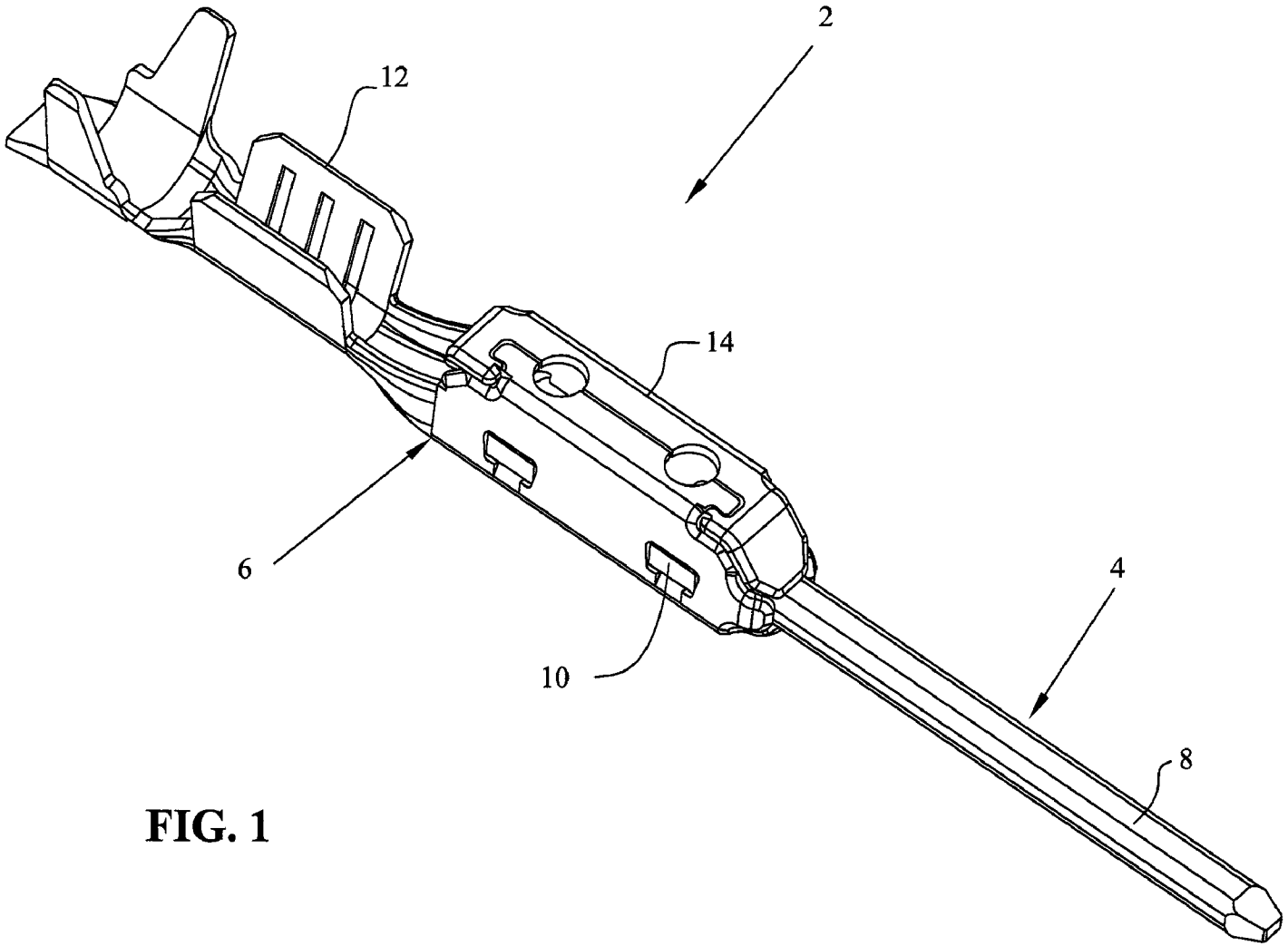
FIG. 1 is a front perspective view of the two piece electrical terminal of the present embodiment.
Figure 2:
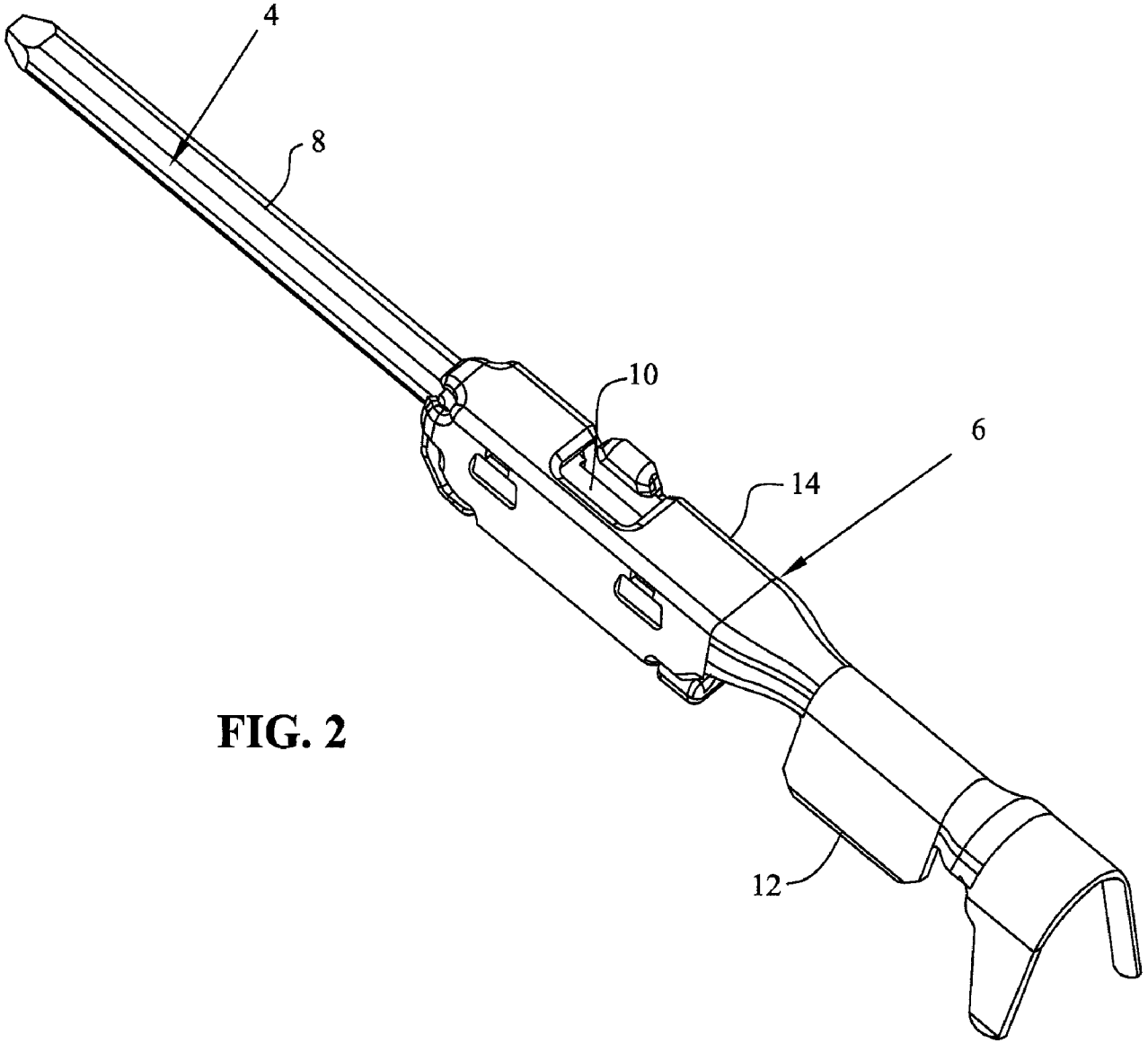
FIG. 2 shows a bottom rear perspective view of the two piece electrical terminal of the present embodiment.
Figure 3:
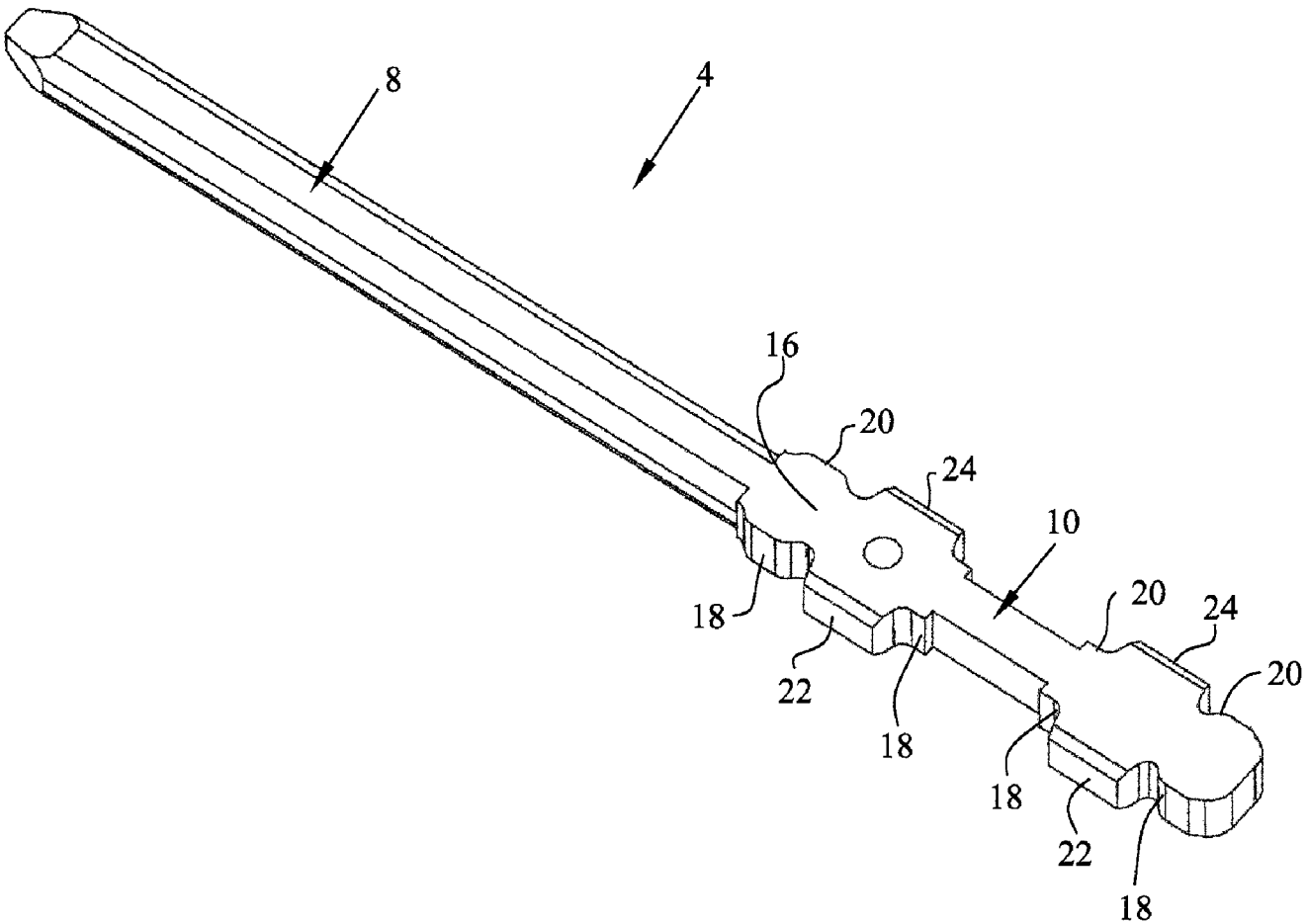
FIG. 3 shows a perspective view of the contact member separate from the conductor connecting member.

With reference first to FIGS. 1 and 2, a two piece electrical terminal is shown at 2 and includes a contact member 4 and a conductor connecting member 6. The contact member 4 is generally comprised of a contact section 8 and a retention section 10. The conductor connecting member 6 is comprised of a conductor connecting section 12 and a retaining member 14. With reference now to FIG. 3, the contact member 4 will be described in greater detail.

As shown in FIG. 3, the contact member 4 is shown separated from the conductor connecting member 6 to clearly show the contact section 8 as a pin terminal and the retention section 10 as integrally formed with the contact section 8. The retention section 10 is generally defined by a flat blade portion 16, having side edges 18 on one side thereof, and side edges 20 on the opposite side thereof. Undulations in the form of tabs 22 extend from the side edge 18, while undulations in the form of tabs 24 extend from side edge 20.

Figure 4:
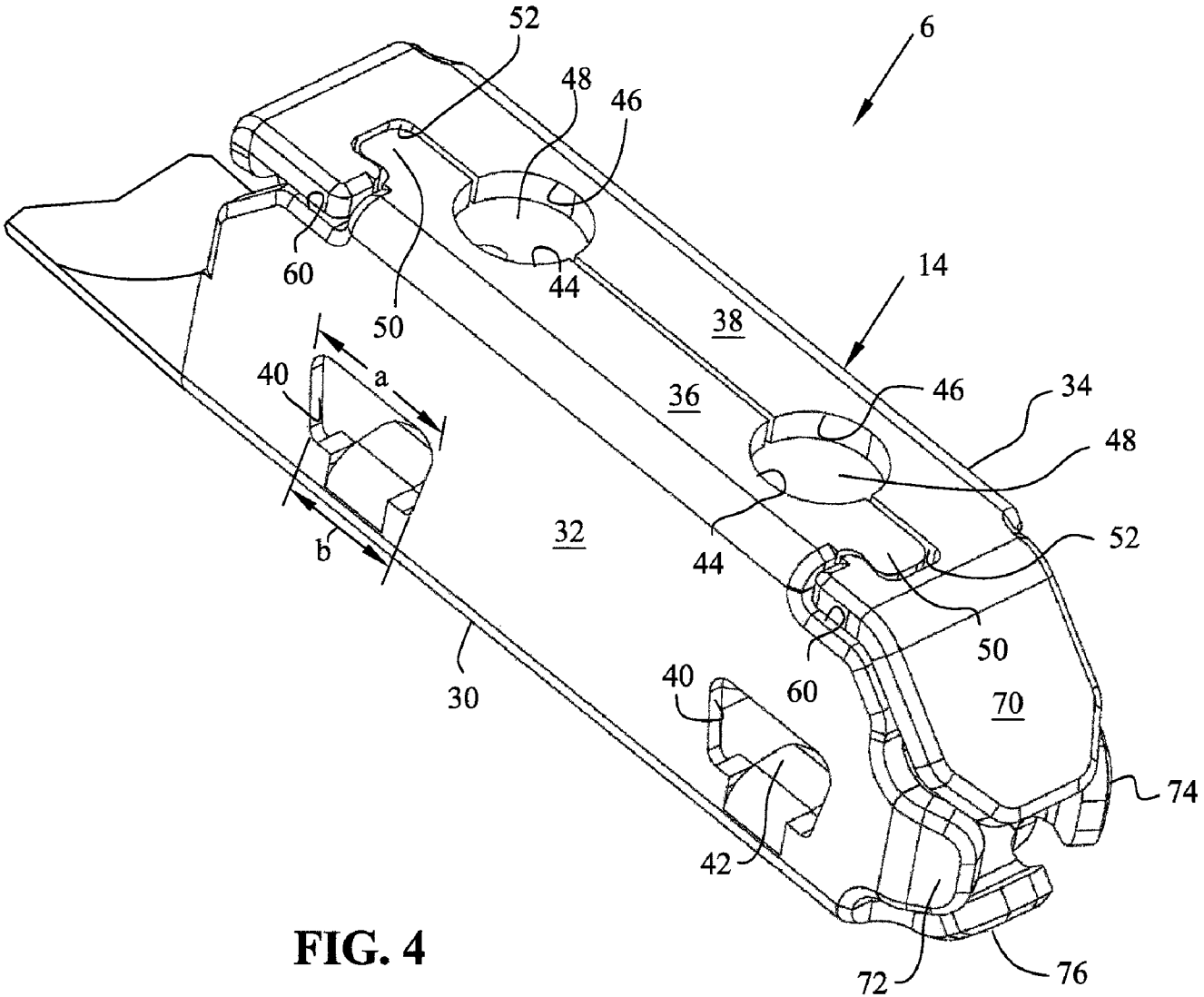
FIG. 4 shows a partially fragmented front view of the conductor connecting member.
Figure 5:
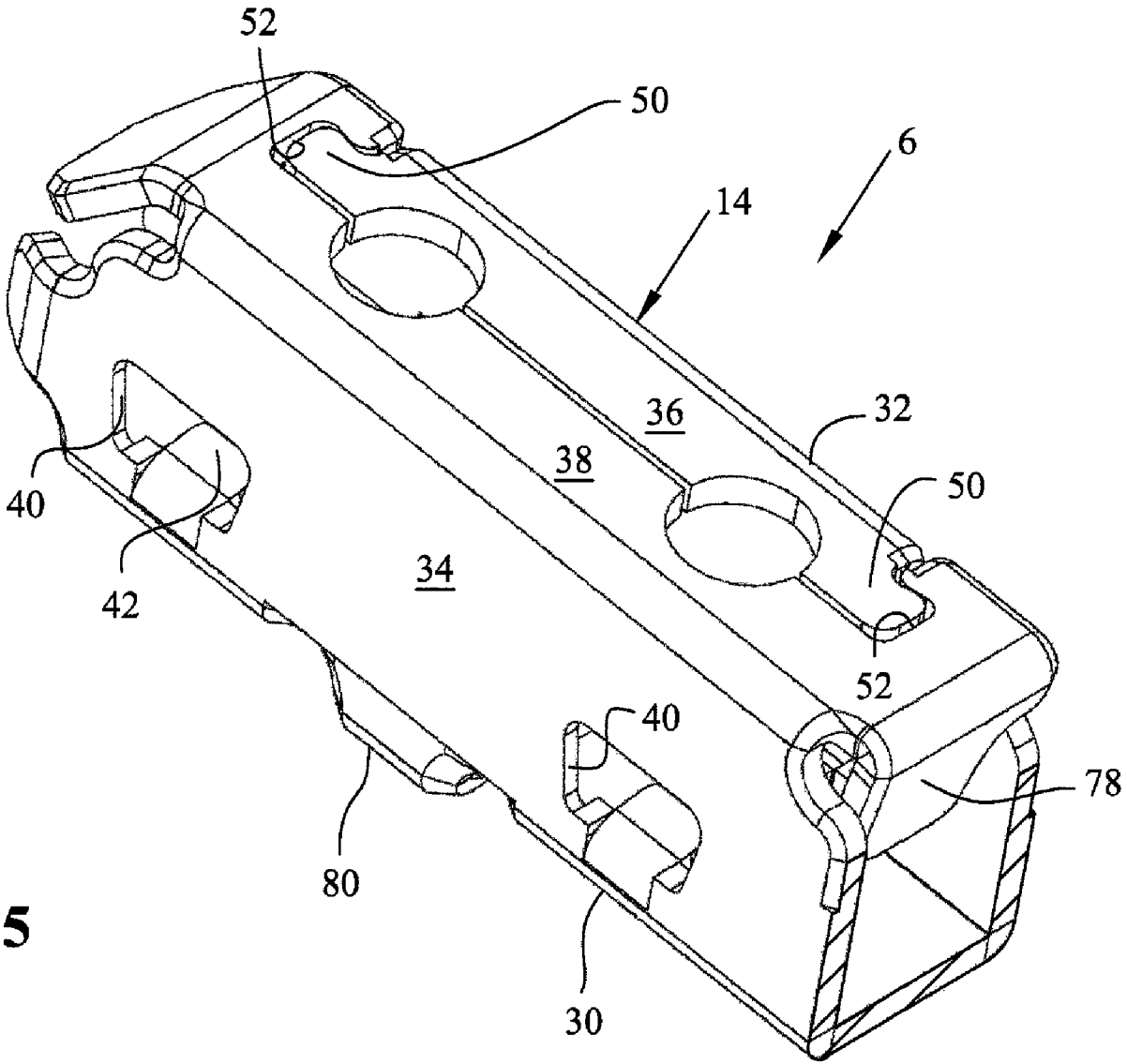
FIG. 5 shows a partially fragmented rear view of the conductor connecting member shown in FIG. 4.

With respect now to FIGS. 4 and 5, the conductor connecting member 6 is shown, and in particular, the retaining member 14 is shown disconnected from the contact member 4. The retaining member 14 is comprised of plural walls, namely bottom wall 30, side walls 32 and 34 and split top walls 36, 38. As shown in FIGS. 4 and 5, walls 32 and 34 include openings 40 stamped there through. Each of the openings 40 includes a contact tab 42 struck from the area of the opening 40 and folded downwardly adjacent to bottom wall 30, as will be described further herein. With reference to FIGS. 4 and 5 split top walls 36, 38 include semi-circular openings 44, 46 which combine to form an opening 48 as described further herein. As shown best in FIG. 4, top wall 36 includes dove tails 50 which cooperate with dove tail slots 52 in top wall 38 to retain the two walls together when in the position shown in FIG. 4.

It should be appreciated that side wall 32 includes cut away portions at 60 (FIG. 4) which allow for top wall 38 to be positioned in the same plane as top wall 36. As shown best in FIG. 4, the front edges of retaining member 14 provide lead in surfaces, by respective front wall portions deflected inwardly. More particularly, top wall 38 includes a portion 70 deflected inwardly towards a central opening through which the pin protrudes. In a like manner, side wall 32 includes inwardly directed portions 72, side wall 34 includes inwardly directed portion 74, and bottom wall 30 includes inwardly directed portion 76.

With respect to FIG. 5, top wall portion 38 also includes a rear tab portion in a form of a flap 78 which provides a surface for a locking member or secondary locking member for the terminal in a connector housing. Finally, as best shown in FIG. 5, retaining member 14 includes a polarizing lug 80 which can be used to polarize the terminal in a specific orientation relative to a connector channel. These various components are also shown in the flat blank view of FIG. 6. Note that the fold lines to form the various walls 30, 32, 34, 36 and 38 are along the dotted lines 84, 86, 88 and 90.

Figure 6:
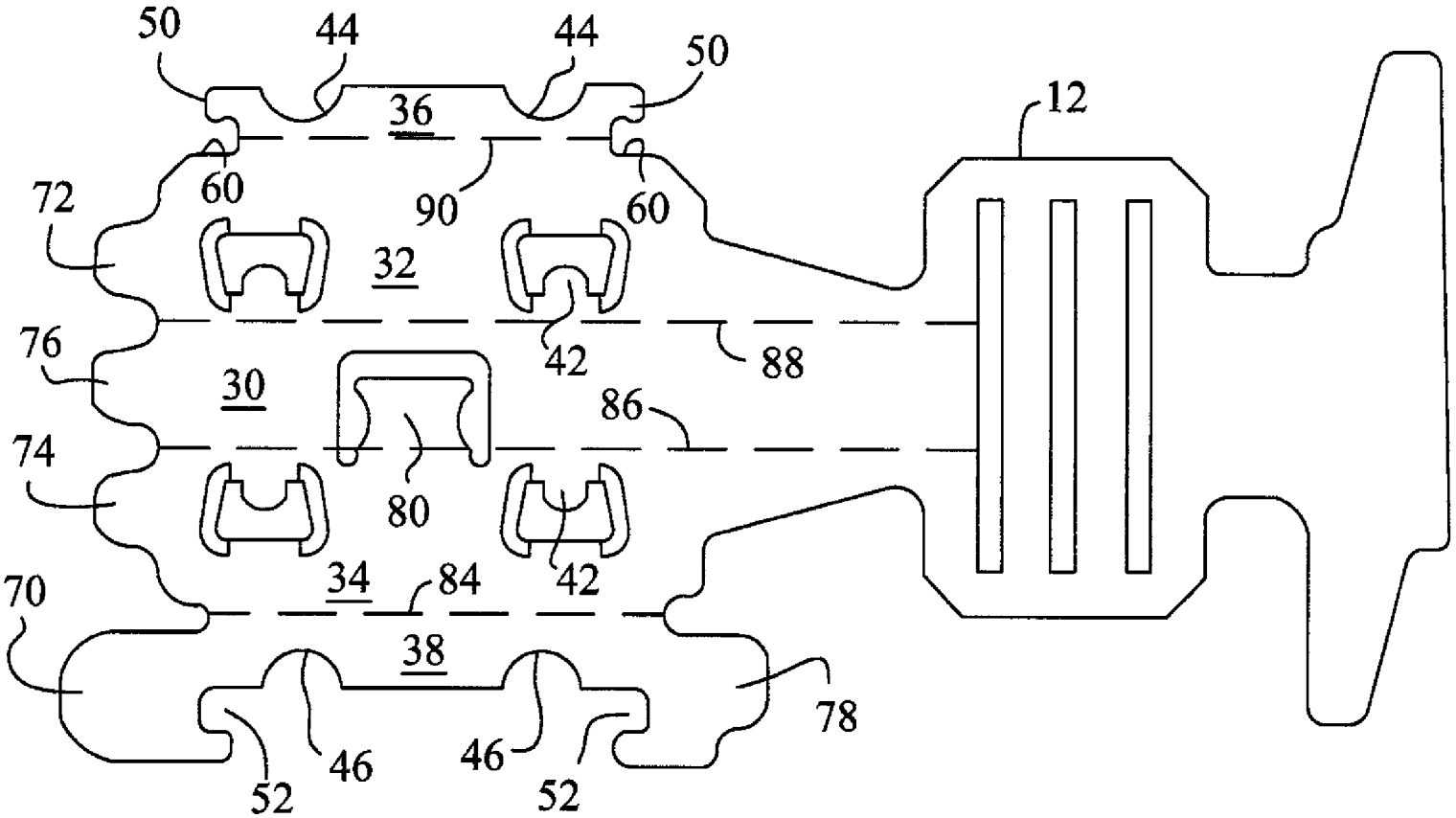
FIG. 6 shows a flat blank of the conductor connecting member shown in either of FIG. 4 or 5 with the conductor connecting section still attached.

With the components described above, the method of manufacturing the terminal will now be described. With the conductor connecting member 6 in the flat blank condition as shown in FIG. 6, the box shaped member is at least partially formed, yet with enough spacing between the split top walls 36, 38 to place the retention section 10 through the front end, to a longitudinal position adjacent the folded over tabs 42. As shown in FIG. 4, the openings 40 are trapezoidally shaped with the top edge having a dimension "a" which is larger than an lower edge having a dimension "b". With the retention section 10 position therein, and the tabs 22, 24 extending outwardly from the openings 40, the box shaped member can be fully closed to the position shown in FIGS. 4 and 5, whereby the dovetails 50 engage in their corresponding dovetail slots 52.

To achieve the fully seated position, tooling can be inserted through openings 48 (FIG. 4) to press against blade portion 16 (FIG. 3) to force the tabs downwardly towards the lower edge having the dimension "b". Simultaneous with this movement, the box is closed by urging the split top walls 36, 38 together, and locking together the dovetail/dovetail slot arrangement, 50, 52. It should be appreciated that the width of the tabs 22, 24 is slightly larger than the width "b" of the lower edge of opening 40, such that tabs 22, 24 are interference fit within the openings 40. Openings 40 form locking members, in that they are shaped as trapezoids funneling downwardly to allow for downward, yet interferingly fit engagement of the tabs 22, 24 within opening 40, which also press fits blade portion 16 against the corresponding overlapping contact tabs 42. Meanwhile, the side edges of the tabs form locking surfaces, which engage the openings 40.

Figure 7:
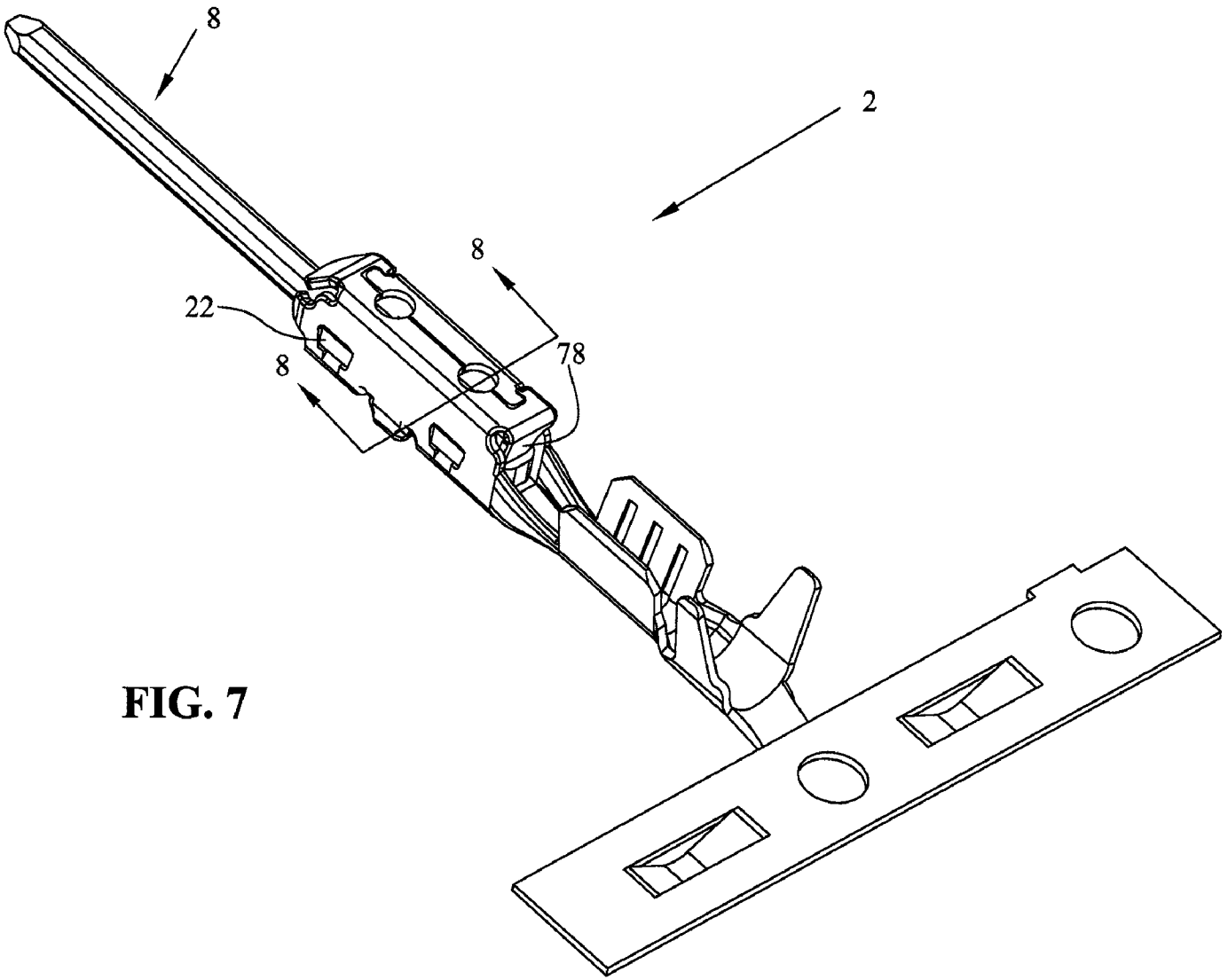
FIG. 7 shows an assembled view of the two-piece electrical terminal from a rear perspective.
Figure 8:
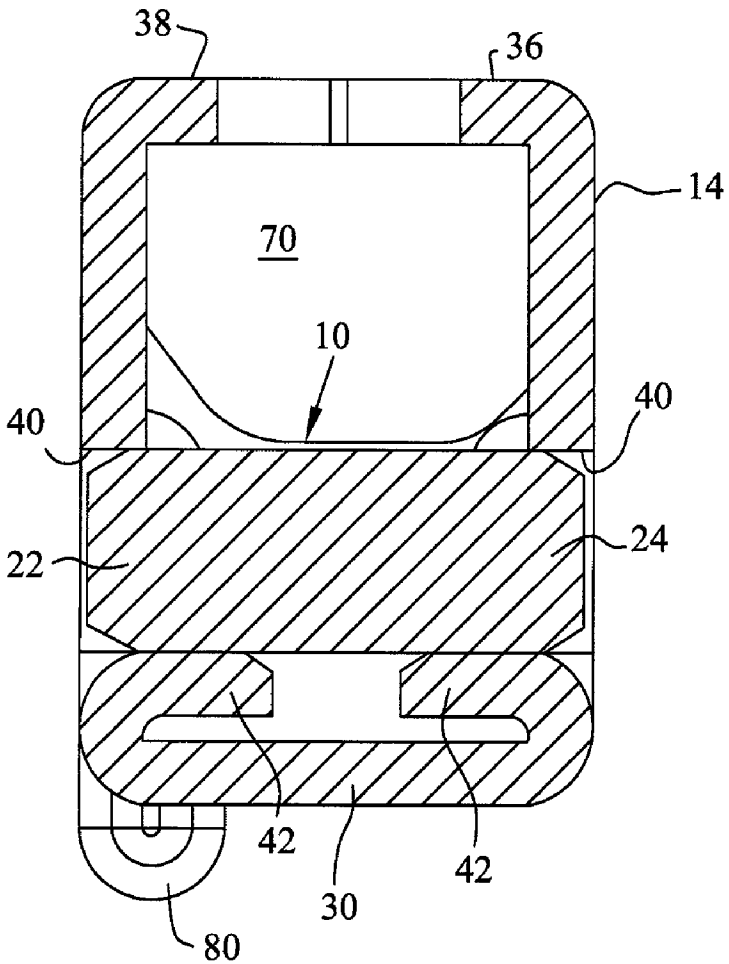
FIG. 8 shows a cross-sectional view through lines 8-8 of FIG. 7.

Thus, as shown in FIGS. 7 and 8, the retaining member 14 is shown wrapped around the retention section 10, with the tabs 22, 24 protruding through their respective openings 40. It is also shown that folded over contact tabs 42 provide a platform upon which the retention section 10 may be positioned, which also provides adequate surface area for making contact between the contact member 4 and the conductor connecting member 6. Thus as shown, the combination of the tabs 22, 24 and openings 40 provide excellent retention between the two members 4 and 6, and at the same time provide electrical connection between the two items together with the connection of the retention section and the contacts 42.

Figure 9:
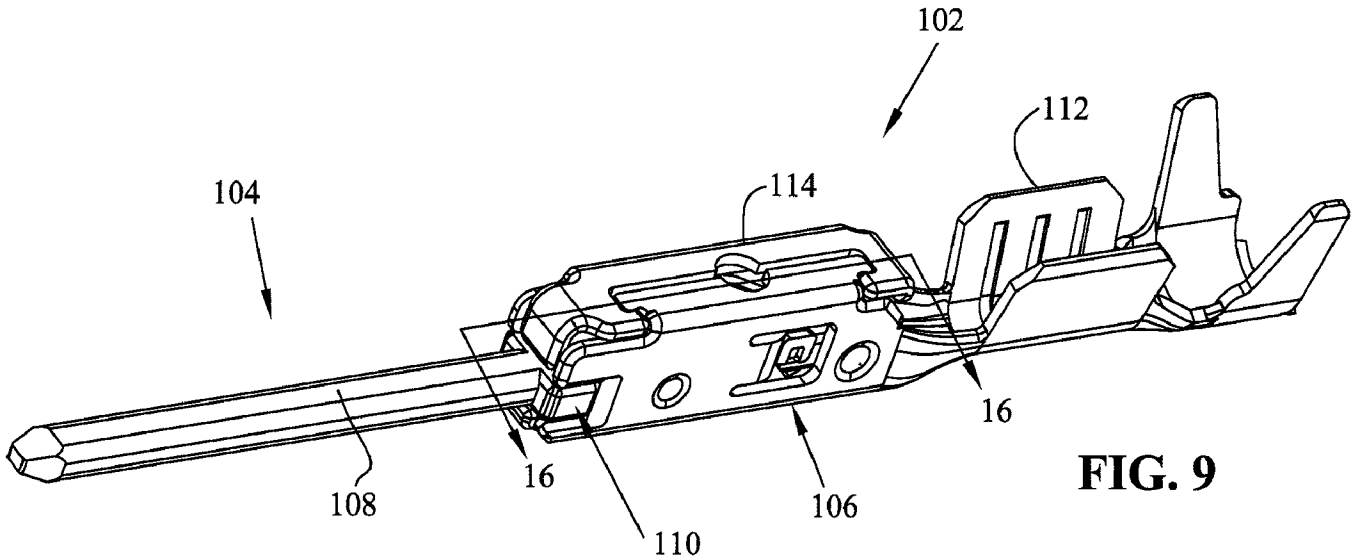
FIG. 9 is a front perspective view of a fully assembled two piece electrical terminal of a second embodiment.
Figure 10:
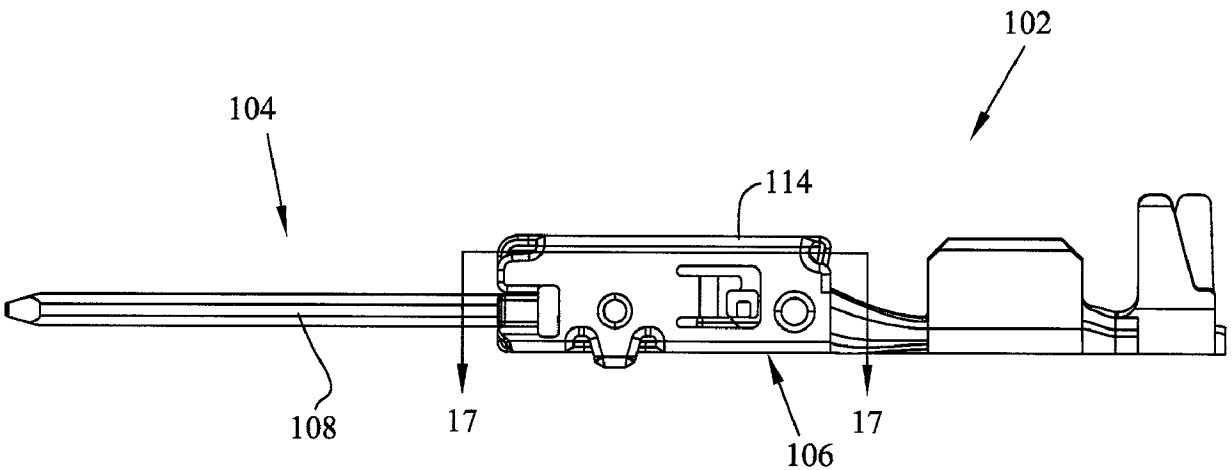
FIG. 10 shows a side plan view of the two piece electrical terminal of the embodiment of FIG. 9.
Figure 11:
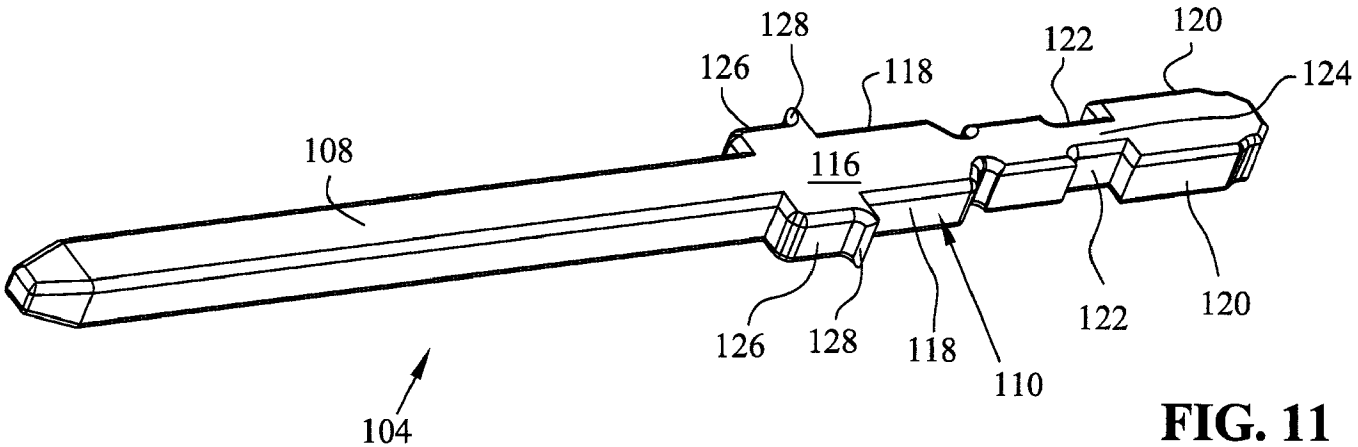
FIG. 11 shows a perspective view of the contact member separate from the conductor connecting member.

With reference now to FIGS. 9-19, and respect first to FIGS. 9 and 10, another embodiment of a two piece electrical terminal is shown at 102 and includes a contact member 104 and a conductor connecting member 106. The contact member 104 is generally comprised of a contact section 108 and a retention section 110. The conductor connecting member 106 is comprised of a conductor connecting section 112 and a retaining member 114. With reference now to FIG. 11, the contact member 104 will be described in greater detail.

As shown in FIG. 11, the contact member 104 is shown separated from the conductor connecting member 106 to clearly show the contact section 108 as a pin terminal and the retention section 110 as integrally formed with the contact section 108. The retention section 110 is generally defined by a flat blade portion 116, having side edges 118 on a forward end, and side edges 120 on rearward end. Notches 122 extend between the side edge 118, 120, and have an upper surface 124, as described herein. Enlarged portions 126 are positioned forward of the side edges 118, and have stop portion 128.

Figure 12:
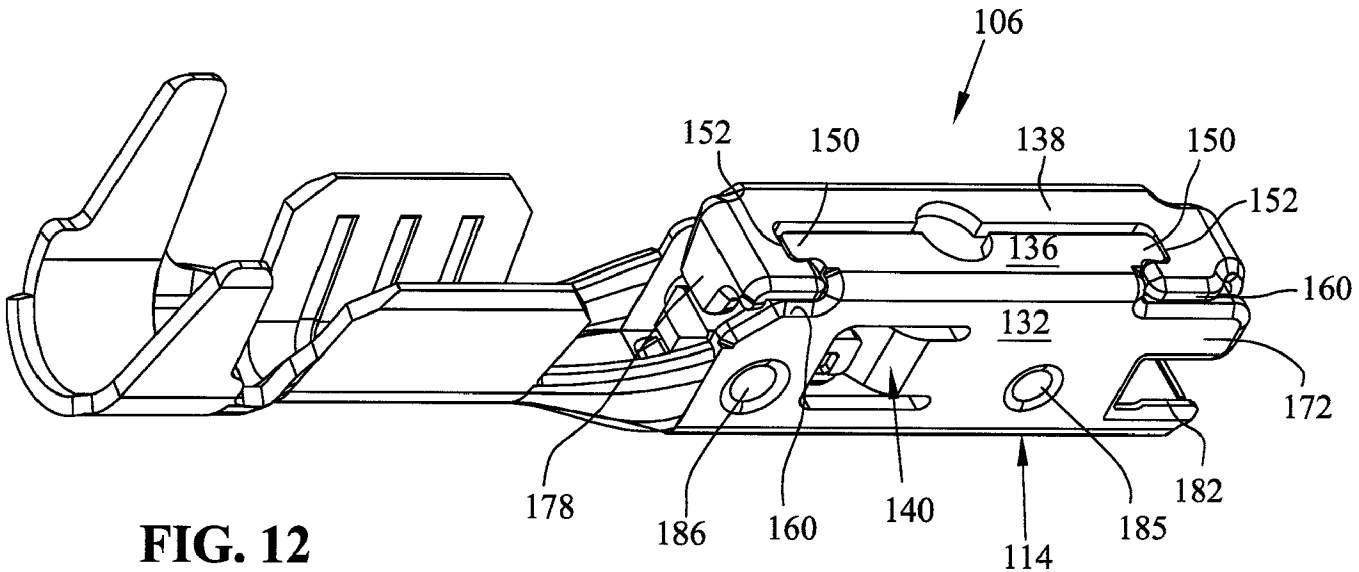
FIG. 12 shows a perspective view of the conductor connecting member, prior to the installation of the contact member.
Figure 13:
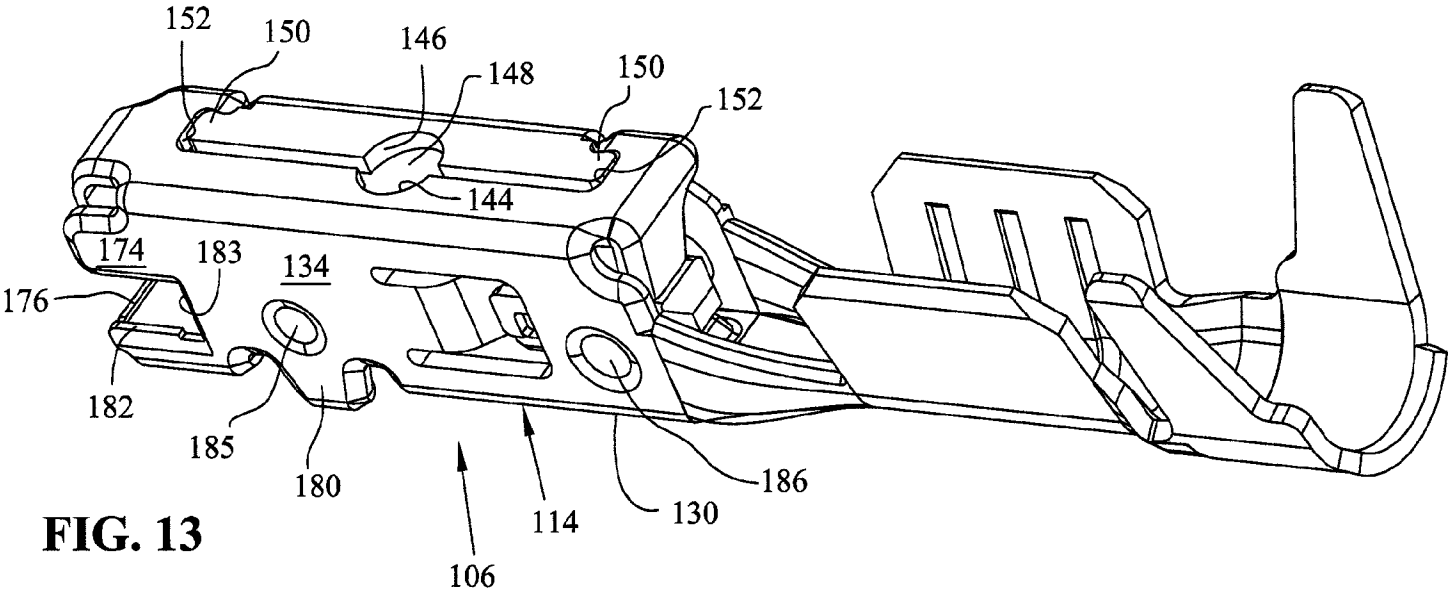
FIG. 13 shows another perspective view of the conductor connecting member, prior to the installation of the contact member.
Figure 14:
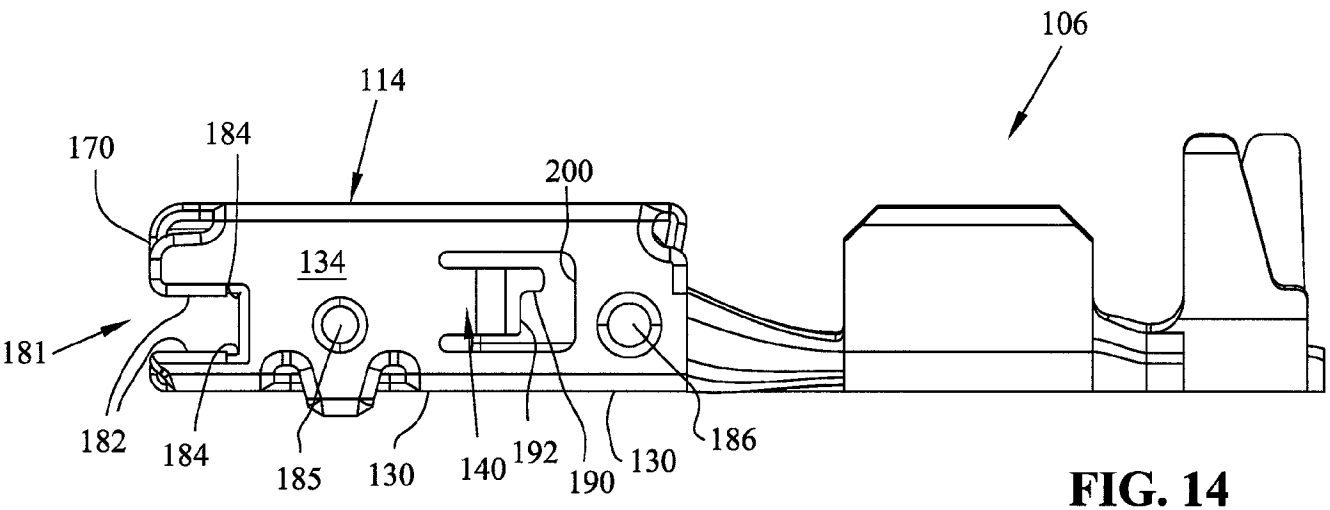
FIG. 14 shows a side plan view of the conductor connecting member of FIG. 13.
Figure 15:
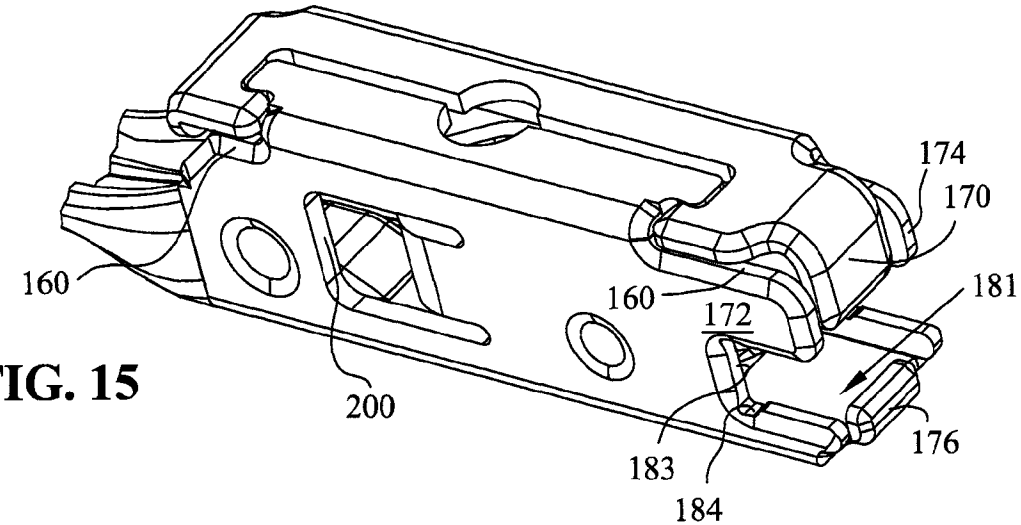
FIG. 15 shows an enlarged partially fragmented front perspective view of the conductor connecting member.
Figure 16:
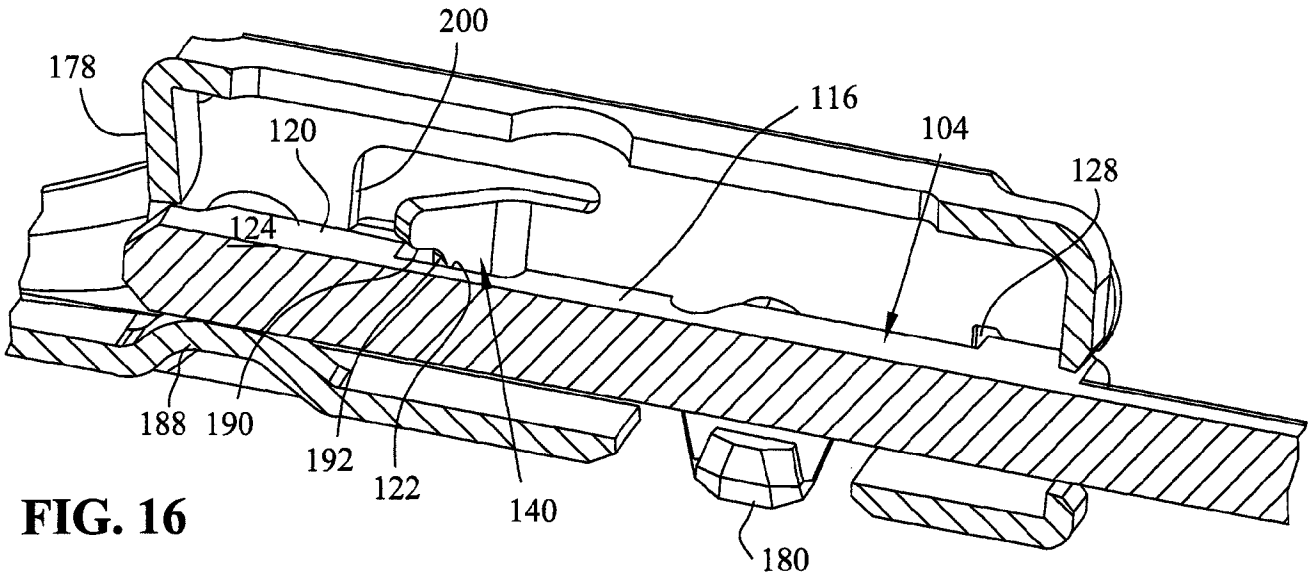
FIG. 16 is a cross-sectional view through lines 16-16 of FIG. 9 where the two piece terminal is partially assembled.

With respect now to FIGS. 12-15, the conductor connecting member 106 is shown, and in particular, the retaining member 114 is shown disconnected from the contact member 104. The retaining member 114 is comprised of plural walls, namely bottom wall 130, side walls 132 and 134 and split top walls 136, 138. As shown in FIGS. 12, 14 and 16, walls 132 and 134 include rearwardly directed latch arms 140 stamped there through. With reference to FIG. 13 split top walls 136, 138 include semi-circular openings 144, 146 which combine to form an opening 148. As shown best in FIGS. 12 and 13, top wall 136 includes dove tails 150 which cooperate with dove tail slots 152 in top wall 138 to retain the two walls together when in the position shown in FIG. 12 or 13.

It should be appreciated that side wall 132 includes cut away portions at 160 (FIG. 12) which allow for top wall 138 to be positioned in the same plane as top wall 136. As shown best in FIGS. 12-15, the front edges of retaining member 114 provide lead in surfaces, by respective front wall portions deflected inwardly. More particularly, top wall 138 includes a wall portion 170 (FIG. 15) deflected inwardly towards a central opening through which the pin protrudes. In a like manner, side wall 132 includes side wall portions 172 (FIG. 12), side wall 134 includes side wall portion 174 (FIG. 13), and bottom wall 130 includes front wall portion 176 (FIG. 15).

With respect to FIG. 12, top wall portion 138 also includes a rear tab portion in a form of a flap 178 which provides a surface for a locking member or secondary locking member for the terminal in a connector housing. As best shown in FIG. 13, retaining member 114 includes a polarizing lug 180 which can be used to polarize the terminal in a specific orientation relative to a connector housing channel. Front end of retaining member 114 includes cutout portions 181 having upper and lower edges 182, a rear edge 183, and notches 184 positioned inward from edges 182, the purpose of which will be described in detail herein. As shown in FIG. 14, the latch arms 140 are rearwardly directed and include an upper shoulder 190 which is profiled to overlie the blade portion 116, and includes an edge 192 which engages notch 122. Sidewalls 132 and 134 include inwardly directed forward dimples 185 (FIGS. 12-14) and sidewalls 132 and 134 include inwardly directed rearward dimples 186. The dimples 185, 186 are provided so as to be in opposing relationship, where a distance between them is less than the distance between side edges 118, 120.

With the components described above, the method of manufacturing the terminal will now be described. With the conductor connecting member 106 in a flat blank condition (similar to that shown in FIG. 6) the box shaped member can be fully closed to the position shown in FIGS. 12-15, where the dovetails 150 engage in their corresponding dovetail slots 152. Contact member 104 can now be slidably received within the conductor connecting member, to a position where stop portions 128 contact rear edge 183 of cutout portions 181.

Figure 18:
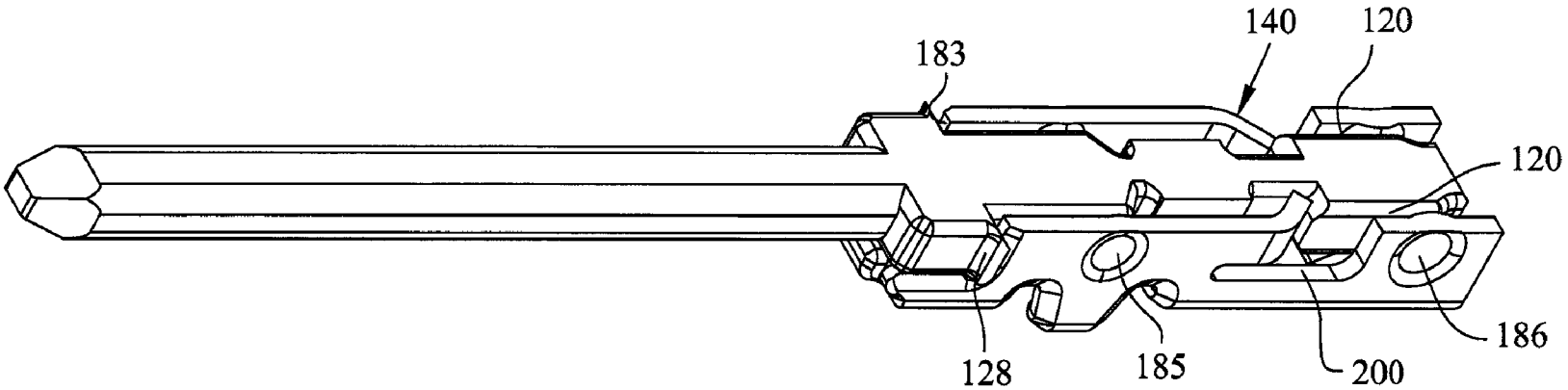
FIG. 18 is a perspective view of the cross-sectional view of FIG. 17.
Figure 17:
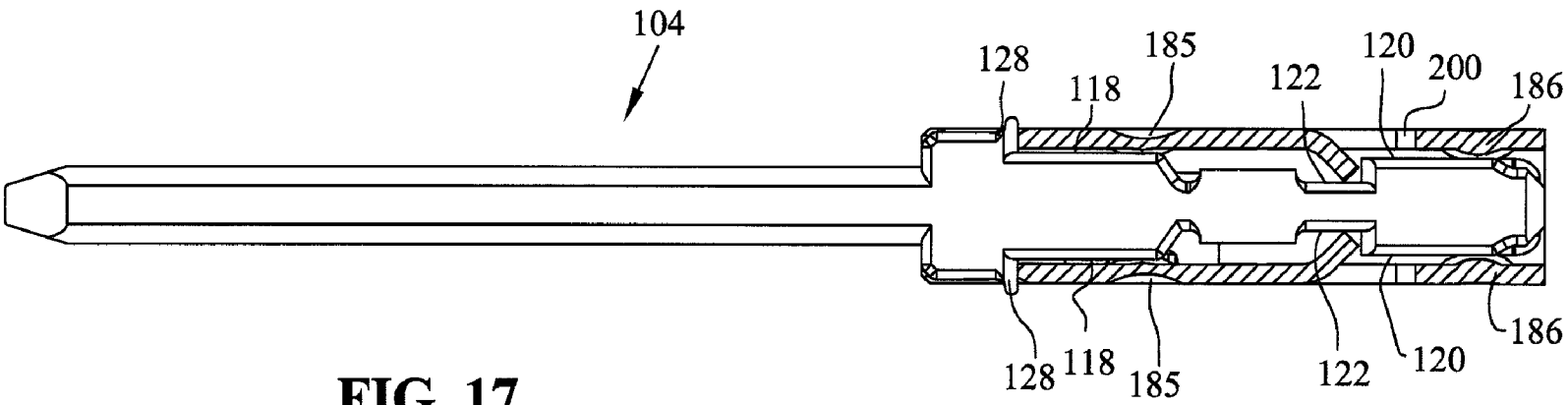
FIG. 17 is a cross-sectional view through lines 17-17 of FIG. 10.

At this point in time, the contact member 104 is not fully locked within the corresponding conductor connecting member 106. However, as best shown in FIGS. 17 and 18, contact member 104 is positioned within the conductor connecting member 106 with dimples 185, 186 in contact with corresponding side edges 118, 120. As best shown in FIGS. 16 and 17, this also positions latch arms 140 within respective notches 122 with upper shoulder 190 extending over top surface 124. More particularly, latch arms 140 form locking members that engage locking surfaces within notches 122. This also positions a bottom contact pad 188 against a lower surface of blade portion 116.

Figure 19:
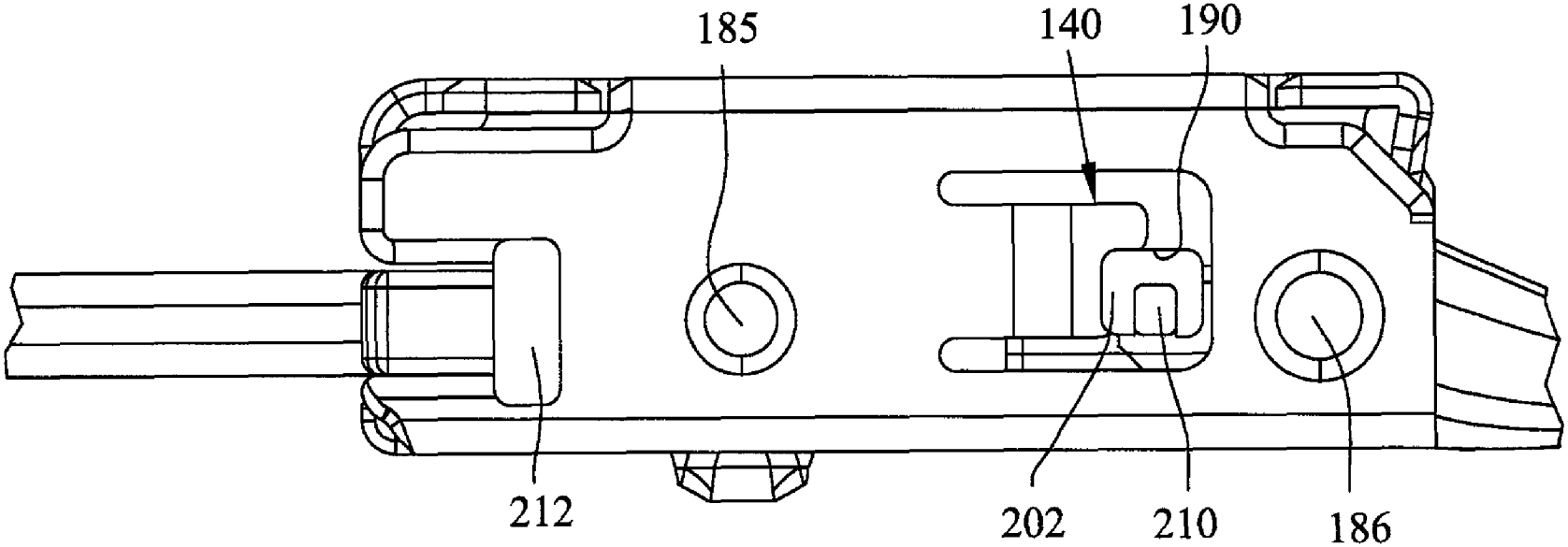
FIG. 19 is an enlarged side view of the conductor connecting member and contact member fully attached.
Figure 20:
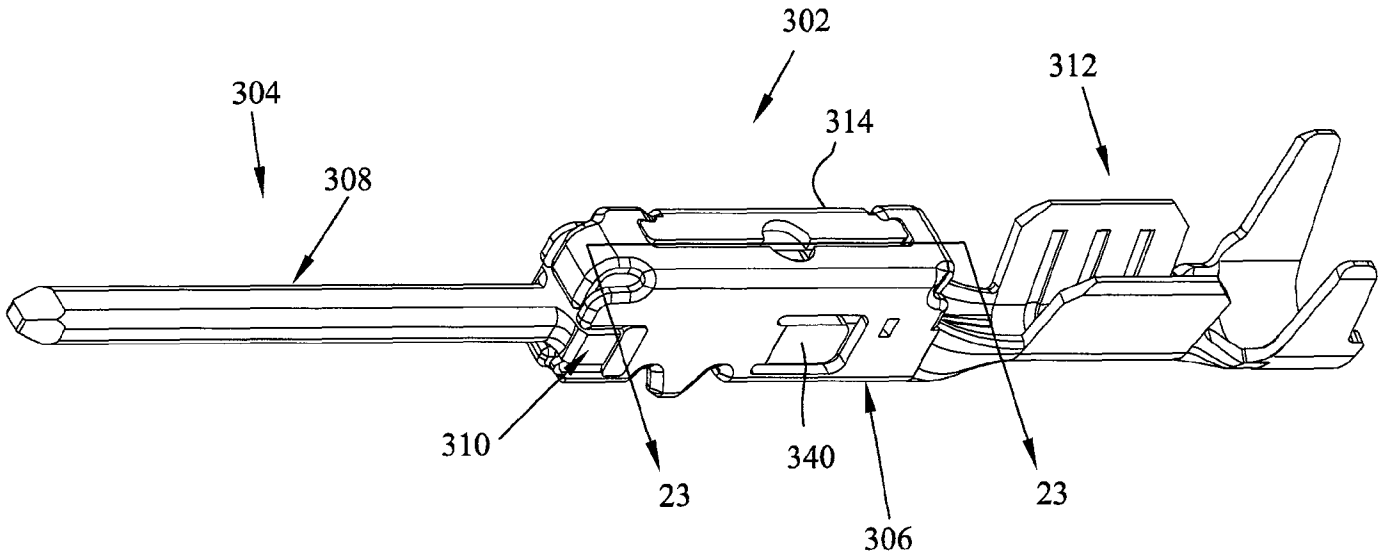
FIG. 20 is a front perspective view of a fully assembled two piece electrical terminal of a third embodiment.
Figure 21:
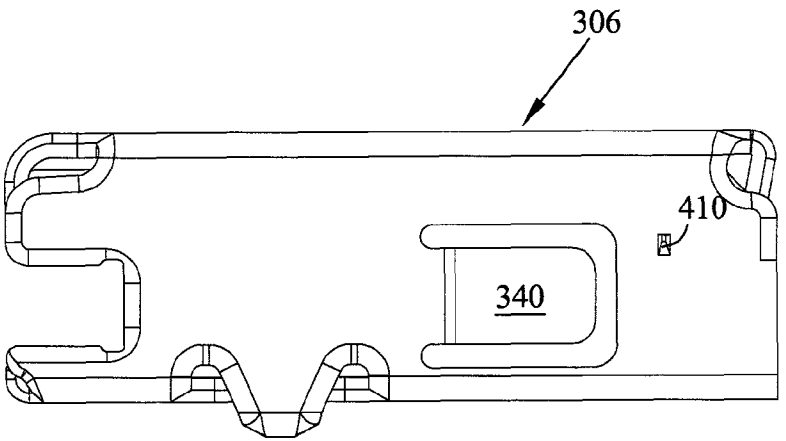
FIG. 21 shows a side view of the retaining member.
Figure 22:
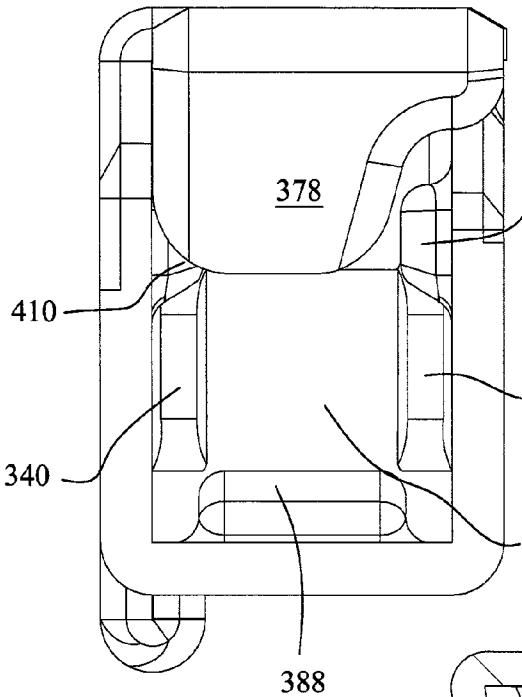
FIG. 22 shows an end view of the retaining member of FIG. 21.
Figure 23:
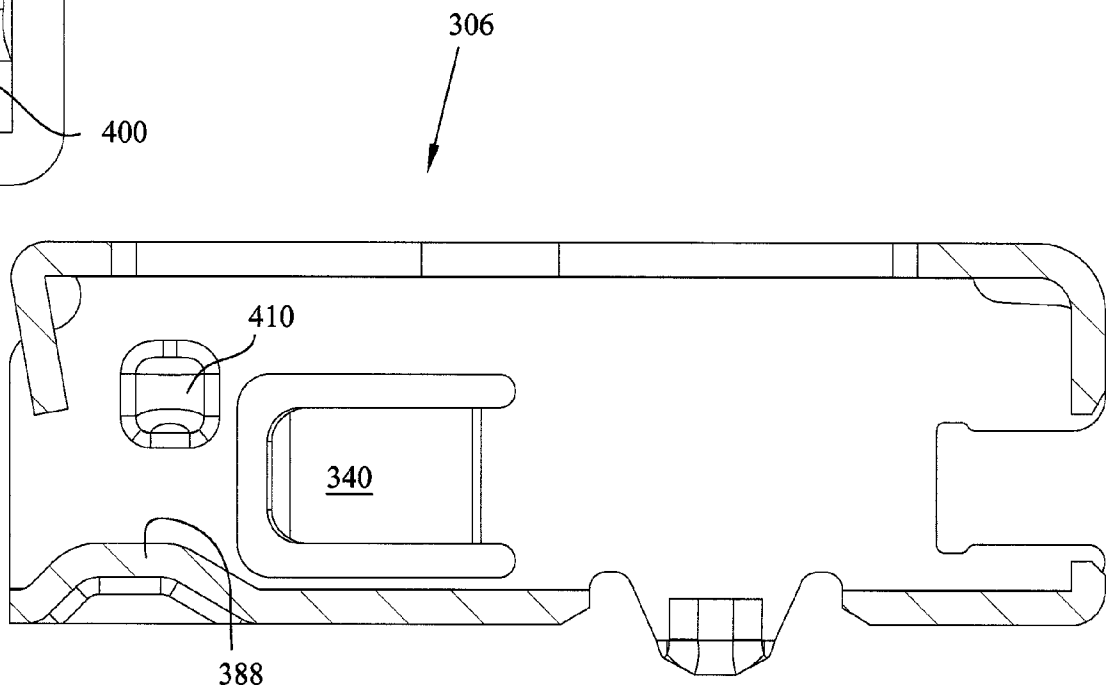
FIG. 23 is a cross-sectional view through lines 23-23 of FIG. 20.
Figure 24:
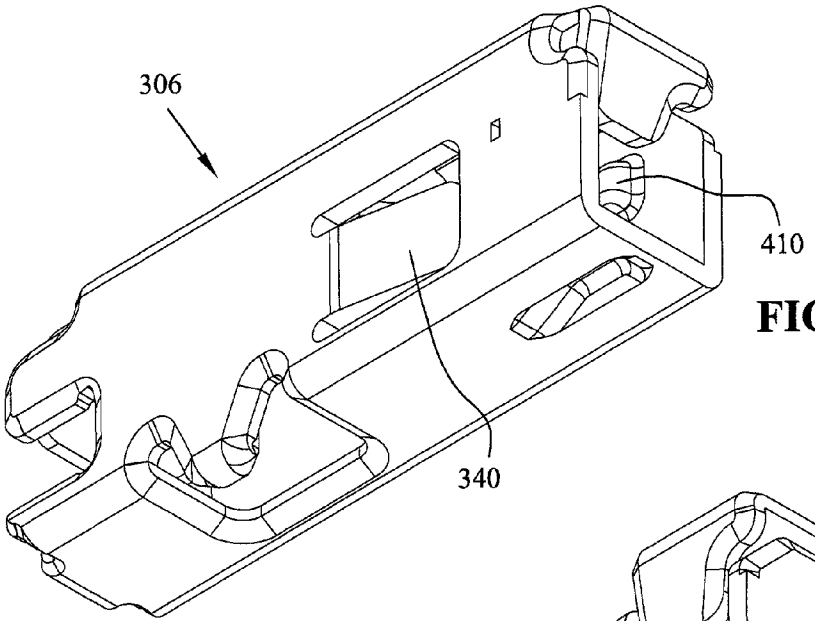
FIGS. 24 and 25 show front perspective views of the retention member of FIG. 21.
Figure 25:
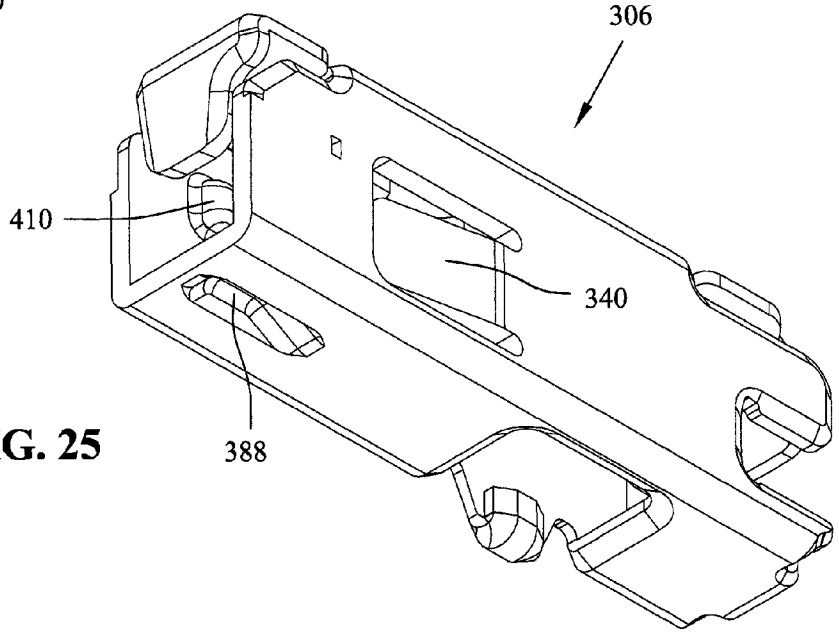

To achieve the fully seated position, tooling can be inserted through openings 200 (FIGS. 16-18) to deformingly press against blade portion 116 to deform the blade portion 116 inwardly at portions 120, to define swaged sections 202 (FIG. 19). It should be appreciated that tooling such as a square punch or peen could be inserted transversely from both sides creating a deformation, such as the squared aperture 210 (FIG. 19). This is turn causes the swaged and enlarged section 202, forming somewhat of a rivet, which forces some material upwardly causing an interference fit between the shoulder 190 and the blade portion 116. At the same time, tooling is directed inwardly against a portion of enlarged portion 126, to deform them into flattened sections 212. Flattened sections 212 force material into the cutout portions 181, and particularly into notches 184 seating the blade portion both laterally and vertically relative to the retaining member 114.

This deforming process extrudes material of blade portion 116 both vertically and horizontally adjacent to arms 140 to remove all float in the direction of insertion, that is axially, and also forces arm 140 to deflect upwardly, thereby causing a downward residual force from edge 190 to the blade 116 to force the blade against bottom contact pad 188.

With respect now to FIGS. 20-26, a third embodiment of two-piece terminal will be described. The two-piece terminal is shown as 302 and is generally comprised of a contact member 304 and a conductor connecting member 306. The contact member 304 is generally comprised of a contact section 308 and a retention section 310. The conductor connecting member 306 is comprised of a conductor connecting section 312 and a retaining member 314. With reference now to FIGS. 21-25, the conductor connecting member 306 will be described in greater detail. It should also be understood that the embodiment of FIGS. 20-26 is similar in nature to the embodiment of FIGS. 9-19 and so only the differences will be described.

As shown in FIGS. 21-25, conductor connecting member 306 differs from conductor connecting member 106 in that it includes inwardly-directed deformations or projections 410 extending inwardly from both sidewalls (as best viewed in FIG. 22), and in that inwardly-directed contact arms 340 extend inwardly from both sidewalls. A rear flap 378 extends downwardly, and a bottom contact pad 388 extends upwardly from the bottom wall, and together with deformations 410 and contact arms 340 provide a locating area 400 (FIG. 22) for the contact member 304 as described herein.

Figure 26:
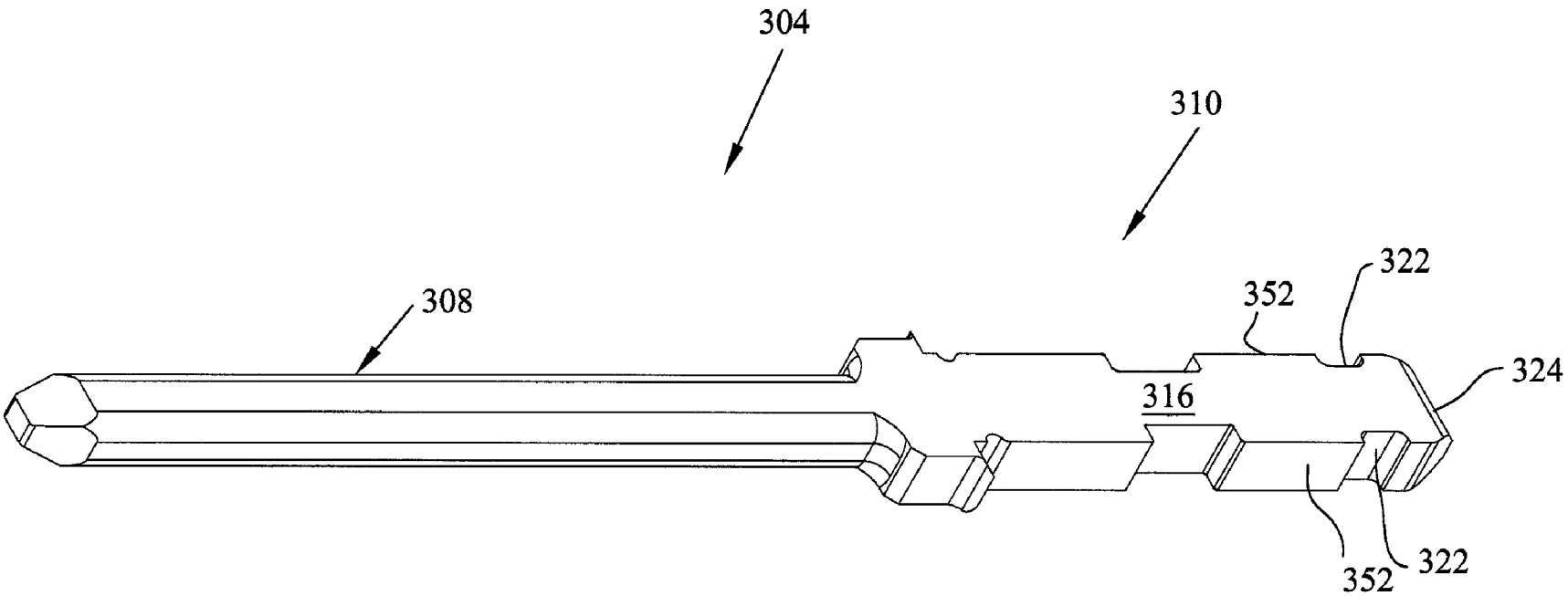
FIG. 26 shows a perspective view of the contact member of the embodiment shown in FIG. 20.

With respect now to FIG. 26, contact member 304 is shown including contact section 308 and retention section 310. Retention section 310 of contact member 304 includes contact surfaces at 352. Undulations in the form of notches are shown at 322 extending adjacent to a free end of contact member 304. The free end of contact member 304 includes chamfered or radiused surfaces 324 to form a lead-in as will be described herein.

As described, contact member 304 is received in conductor connecting member 306 in a like manner as described with reference to the embodiment of FIG. 9. However, in this case, the lead in section 324 is received into area 400 and deformations 410 cause retention section 310 to be guided below deformations 410 and with flat blade portion 316 slightly against contact pad 388. The contact surfaces 352 are longitudinally arranged and wide enough so as to make spring loaded contact with contact arms 340 and undulations are longitudinally aligned to be positioned at a longitudinal position underlying deformations 410. At this point, deformations 410 can be further deformed causing material to flow into undulations 322 locking the two-piece terminal together. This also forces the retention section 310 downwardly further into electrical contact with bottom contact pad 388.

In each of the above three embodiments, the 2-piece terminal 2, 102 and 302 are retained together by an interlocking between respective contact members 4, 104 and 304 and their counterpart conductor connecting members 6, 106, 306. More particularly, the terminal contact members 4, 104 and 304 have at least one locking surface (edges of tabs 22, 24, FIG. 3; inner edges of notches 122, FIG. 11; and inner edges of notches 322, FIG. 26) and the retaining members 14, 114 and 314 engage the locking surfaces (by way of openings 40, latch arms 140 and deformations 410) to retain the 2-piece terminal together.

In addition, or alternatively, the retention between respective contact members 104 and 304 and their counterpart conductor connecting members 106, 306 can include the flattened sections 212 extending into the notches 184.

The retention may be by way of an interference fit. In the case of terminal 2, the inference fit is defined between the tabs 22, 24 as they are forced downwardly into openings 40. In the case of terminal 102, the interference fit is defined by the swaged sections 202 and latch arms 140. In the case of terminal 302, the interference fit is defined between the deformations 410 and the notches 322.

What is claimed is:

1. A method of forming an electrical terminal, comprising the following steps:

forming a contact member comprised of a contact section and a retention section, wherein a profile of said retention section is larger than a profile of the contact section;

forming at least one locking surface on said retention section;

forming a conductor connecting member comprised of a deformable wire conductor connecting section and a retaining member;

forming at least one engagement surface on said retaining member;

forming at least one inwardly directed contact pad on said retaining member;

forming at least one of the locking surface or the engagement surface to be transverse to a longitudinal direction; and causing movement between the retaining member relative to, and into engagement with, the enlarged profiled section of the retention member, thereby causing interlocking interengagement between the locking surface and the engagement surface in a direction opposing longitudinal movement of the contact member and conductor connecting member, and causing contact engagement between the retention section and the inwardly directed contact pad.

2. The method of claim 1, wherein said retention section is brought into electrical contact with said retaining member.

3. The method of claim 1, wherein the step of causing movement between the retaining member and the enlarged profiled section of the retention member comprises deformation of either the retention section or the retaining member.

4. A two-piece electrical terminal, comprising:

a contact member comprised of a contact section and a retention section, said retention section having at least one locking surface defined by a forwardly facing edge;

a conductor connecting member comprised of a conductor connecting section and a retaining member, the retaining member comprising a plurality of walls surrounding the retaining section, where at least one of the walls includes an inwardly formed contact pad and another of the walls includes an inwardly formed deformation, the inwardly formed deformation engaging said at least one forwardly facing edge to retain the contact member and conductor connecting member together, and the inwardly formed deformation forcing the retention section into the inwardly formed contact pad; and wherein said contact member and said conductor connecting member are discrete members and said retention section makes electrical contact with said retaining member.

5. The electrical terminal of claim 4, wherein the locking member and the locking surface are locked by an interference fit.

6. The electrical terminal of claim 5, wherein said one locking surface is defined by an undulation, and said deformation interferingly fits with said undulation.

7. The electrical terminal of claim 4, wherein said retaining member is in the form of a box-shaped portion overlapping said retention section.

8. The electrical terminal of claim 7, wherein said contact pad is defined in a lower wall.

9. The electrical terminal of claim 8, wherein said at least one deformation is defined in a side wall.

10. The electrical terminal of claim 9, wherein said retention section comprises at least two locking surfaces defined by forwardly facing edges, and the retaining member comprising two side walls surrounding the retaining section, where both walls include inwardly formed deformations engaging corresponding forwardly facing edges to retain the contact member and conductor connecting member together.

* * * * *